US008824947B2

(12) United States Patent
Maeda

(10) Patent No.: US 8,824,947 B2
(45) Date of Patent: Sep. 2, 2014

(54) FIXING DEVICE AND IMAGE FORMING APPARATUS INCLUDING THE SAME

(75) Inventor: Tomohiro Maeda, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 279 days.

(21) Appl. No.: 13/332,584

(22) Filed: Dec. 21, 2011

(65) Prior Publication Data

US 2012/0201584 A1 Aug. 9, 2012

(30) Foreign Application Priority Data

Feb. 3, 2011 (JP) ..... 2011-022008

(51) Int. Cl.
*G03G 15/20* (2006.01)

(52) U.S. Cl.
USPC ..... 399/336

(58) Field of Classification Search
USPC ..... 399/336
See application file for complete search history.

(56) References Cited

U.S. PATENT DOCUMENTS

| | | | | |
|---|---|---|---|---|
| 3,676,350 | A * | 7/1972 | Wright et al. | 430/109.1 |
| 3,849,165 | A * | 11/1974 | Stahly et al. | 430/119.1 |
| 3,944,783 | A * | 3/1976 | Donnelly et al. | 219/216 |
| 3,980,863 | A * | 9/1976 | Wulz et al. | 219/388 |
| 4,034,186 | A * | 7/1977 | Bestenreiner et al. | 219/216 |
| 4,049,947 | A * | 9/1977 | Bestenreiner et al. | 219/216 |
| 4,456,370 | A * | 6/1984 | Hayes, Jr. | 399/50 |
| 4,794,422 | A * | 12/1988 | Lehman et al. | 399/52 |
| 4,972,030 | A * | 11/1990 | Bauman | 524/523 |
| 6,461,782 | B1 * | 10/2002 | Sasada et al. | 430/109.2 |
| 6,587,665 | B2 * | 7/2003 | Bartscher et al. | 399/336 |
| 6,665,516 | B2 * | 12/2003 | Morgenweck et al. | 399/336 |
| 2002/0146650 | A1 * | 10/2002 | Kokeguchi et al. | 430/351 |
| 2004/0006158 | A1 * | 1/2004 | Horie et al. | 523/160 |
| 2004/0006159 | A1 * | 1/2004 | Horie et al. | 523/160 |
| 2004/0060465 | A1 * | 4/2004 | Yamasaki et al. | 101/453 |
| 2004/0067434 | A1 * | 4/2004 | Kano et al. | 430/270.1 |
| 2007/0014584 | A1 * | 1/2007 | Fletcher et al. | 399/50 |
| 2007/0280758 | A1 * | 12/2007 | Ciaschi et al. | 399/336 |
| 2007/0287085 | A1 * | 12/2007 | Iwanaga et al. | 430/66 |
| 2008/0095558 | A1 * | 4/2008 | Schleusener | 399/336 |
| 2008/0101832 | A1 | 5/2008 | Yaoi et al. | |
| 2009/0175663 | A1 * | 7/2009 | Taniuchi et al. | 399/320 |
| 2009/0239172 | A1 * | 9/2009 | Ciaschi et al. | 430/111.4 |
| 2009/0290907 | A1 * | 11/2009 | Kawamura et al. | 399/111 |

(Continued)

FOREIGN PATENT DOCUMENTS

| | | |
|---|---|---|
| JP | 04-022971 | 1/1992 |
| JP | 07-191560 | 7/1995 |
| JP | 11-038802 | 2/1999 |

(Continued)

*Primary Examiner* — David Bolduc
(74) *Attorney, Agent, or Firm* — Renner, Otto, Boisselle & Sklar, LLP

(57) ABSTRACT

A recording sheet has an unfixed toner image that is formed thereon, and is conveyed to a fixing device. A surface reforming device of the fixing device performs surface reformation for the surface of the toner on the recording sheet by, for example, plasma irradiation or the like, thereby generating a polar group of a hydrophilic property on the surface of the toner. Next, the recording sheet is conveyed to a laser irradiation portion by a recording sheet conveyance device to be irradiated with a laser, in which the toner is fused to be fixed to the recording sheet. The toner on the recording sheet is subjected to surface reforming treatment, thus having increased affinity (adhesion force) with the recording sheet, so that it is possible to secure favorable fixability without pressing.

5 Claims, 4 Drawing Sheets

(56) References Cited

U.S. PATENT DOCUMENTS

| | | | | |
|---|---|---|---|---|
| 2010/0296979 | A1* | 11/2010 | Hori et al. | 422/186.04 |
| 2011/0116851 | A1* | 5/2011 | Tanaka et al. | 399/336 |
| 2011/0222935 | A1* | 9/2011 | Egusa et al. | 399/336 |
| 2013/0130172 | A1* | 5/2013 | Tombs et al. | 430/124.15 |

FOREIGN PATENT DOCUMENTS

| | | |
|---|---|---|
| JP | 11-202671 | 7/1999 |
| JP | 2005-055516 | 3/2005 |
| JP | 2008-107576 | 5/2008 |
| JP | 2010-217731 | 9/2010 |

* cited by examiner

FIXING DEVICE AND IMAGE FORMING APPARATUS INCLUDING THE SAME

This Nonprovisional application claims priority under 35 U.S.C. §119(a) on Patent Application No. 2011-22008 filed in Japan on 3 Feb. 2011, the entire contents of which are hereby incorporated by reference.

BACKGROUND OF THE INVENTION

1. Field of the Invention

The present invention relates to a fixing device used for an electrophotographic image forming apparatus such as a copier, a printer or a facsimile, and more specifically to a fixing device for fixing an unfixed image formed on a recording member by noncontact means such as laser beam irradiation means, and an image forming apparatus including the same.

2. Description of the Prior Art

An electrophotographic image forming apparatus (for example, a copier, a printer, a facsimile or the like) is provided with a fixing device for fixing a toner image formed on a recording member (recording sheet, or the like) by heating and fusing. As an example of such a fixing device, as shown in the following Patent Literature 1, a roller-pair system fixing device comprised of a fixing roller and a pressing roller is known.

The fixing roller is a roller member having an elastic layer formed on the surface of a hollow cored bar made of metal such as aluminum, and has a configuration in which a halogen lamp is arranged inside the cored bar as a heat source. A temperature control device then performs on/off control of the halogen lamp based on a signal that is output from a temperature sensor provided on the surface of the fixing roller, thereby controlling temperature on the surface of the fixing roller.

The pressing roller is a roller member having a heat-resistant elastic layer such as silicone rubber provided on the cored bar as a coating layer. Such a pressing roller is in press-contact with a peripheral face of the fixing roller, having a nip area that is formed with the fixing roller therebetween due to elastic deformation of the above-described elastic layer of the pressing roller.

With the above-described configuration, in the fixing device, a recording sheet on which an unfixed toner image is formed is held in the nip area between the fixing roller and the pressing roller, and both of these rollers are rotated, thereby conveying the above-described recording sheet, as well as fusing and fixing on the recording sheet the toner image on the recording sheet by heat of the peripheral face of the fixing roller.

However, in a conventional roller-pair system, the fixing roller and the pressing roller right after supplying power are at room temperature in the case of a power-off state of the device for a long period of time, thus needed to be increased to a predetermined temperature and required to have a warm-up period. Moreover, in a stand-by state where printing operation (image forming operation) is not performed, it is necessary to maintain the surface of the roller at the predetermined temperature, thus having to be heated all the time even when the printing operation is not performed. Therefore, wasted energy is consumed other than the printing operation.

Consequently, as a method of effectively fixing only a toner without consuming wasted energy, a fixing device has been proposed for fixing a toner using laser power as described in the following Patent Literature 2.

According to Patent Literature 2, a plurality of lasers are used to directly heat a toner. Thus, a plurality of lasers are used so that fixability which is insufficient only with one weak laser is improved. Thereby, the surface of the fixing roller is not needed to be maintained at a predetermined temperature, and wasted energy is thus not consumed. It is also described that it is possible to use an inexpensive laser by low output, thus making it possible to also simplify the whole of the device.

Patent Literature 1: Japanese Patent Application Laid-Open Hei 11 No. 38802

Patent Literature 2: Japanese Patent Application Laid-Open Hei 7 No. 191560

Like Patent Literature 1, in the case of a contact-fixing method for fixing a toner by heating and pressing including widely-used roller fixation, belt fixation and the like, for adhesion between the toner and a recording sheet, the toner which is fused by heating is subjected to pressure with a roller nip portion (contact portion of a roller which serves as an upper roller) so as to have promoted diffusion (adhesion force) to paper for adherence, thereby attaining favorable fixability.

However, in the case of a laser fixing device as described in Patent Literature 2, there is no pressing means, and it is thus impossible to impart diffusing strength to a recording sheet. Diffusion (adhesion force) of a toner to a recording sheet is controlled by factors such as viscosity when a toner is fused, wettability to a recording sheet and the like. Accordingly, even when a toner is fused to have lowered viscosity, the toner has no diffusion (adhesion) to a recording sheet in the case of having inferior affinity to the sheet in some cases.

SUMMARY OF THE INVENTION

The present invention has been devised in view of the above-described problems, and an object thereof is to provide a fixing device for reforming a surface of a toner on a recording sheet to increase affinity of the toner that is heated and fused by a noncontact fixing portion to the recording sheet, thereby obtaining a favorable fixed image, and an image forming apparatus including the same.

The present invention provides a fixing device for fixing an unfixed toner image in noncontact while conveying a recording member on which the toner image is formed, including a surface reforming portion for reforming a surface of the toner on the recording member so as to increase affinity to the recording member in heating and fusing, and a noncontact fixing portion for heating and fusing in noncontact the toner whose surface is reformed.

Further, the recording member is paper and the surface reforming portion increases affinity to the recording member by generating a polar group of hydrophilic property on the surface of the toner.

Further, the noncontact fixing portion fixes a toner image by irradiation of light, and preferably uses a laser beam. Additionally, the noncontact fixing portion desirably uses a semiconductor laser. Note that, in this case, a laser array is configured such that a plurality of semiconductor laser elements are disposed in an array in a direction orthogonal to a conveyance direction of the recording member.

Further, the present invention provides an image forming apparatus provided with the fixing device.

According to the present invention, a surface of a toner formed on a recording member is subjected to surface reformation by means of, for example, plasma irradiation or the like so as to increase affinity to the recording member, thereby increasing adhesiveness to the recording member when a toner is heated and fused so that it is possible to secure favorable fixability. In particular, in a case where the recording member is a recording sheet, a polar group of a hydrophilic property is generated on the surface of the toner so that it is possible to increase affinity to the recording member.

Further, as a noncontact-fixing method, heating is performed by light irradiation so that there is no need for warm-up of a heating portion, and it is possible to heat and fuse instantly only at the time of desiring fixation to effectively perform fixation.

Further, as a light irradiation portion, since a laser has less light diffusion, a largest amount of light is able to be condensed by the combined use of a laser and a condensing lens so that it is possible to bring maximum light intensity (light output per unit area: $W/mm^2$), thus making it possible to effectively irradiate with light.

Further, in the case of laser irradiation, it is possible to selectively heat only a location where a toner is present, and the toner is able to be further effectively heated.

Additionally, a semiconductor laser is used among lasers so that it is possible to reduce the cost because of lower cost of elements compared to use of a CO2 laser and a YAG laser.

Moreover, semiconductor laser elements are disposed in a line in a sheet conveyance direction and a vertical direction so that it is not necessary to scan with a laser in the sheet conveyance direction and the vertical direction, thus enabling use in a most basic configuration and also fixation at high speed.

Furthermore, since such a fixing device is used so that it is possible to shorten a warm-up period of an image forming apparatus and consumed power is not needed at the time of standby, it is possible to attain an image forming apparatus having low consumed power.

DESCRIPTION OF THE PREFERRED EMBODIMENTS

Figure 1:
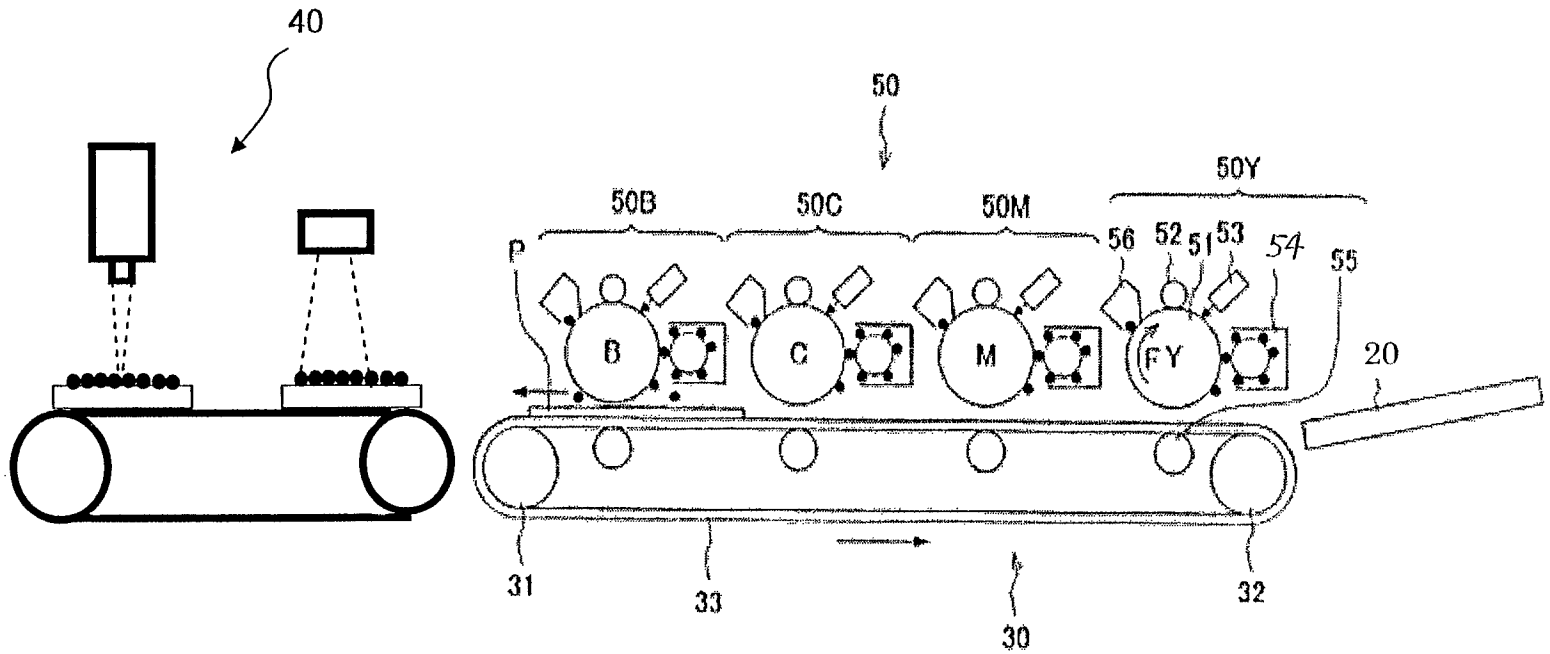
FIG. 1 is a schematic view showing an embodiment of a color image forming apparatus according to the present invention.

Description will be hereinafter given in detail for preferred embodiments of the present invention with reference to accompanying drawings. Note that, in the specification and the drawings herein, the components having substantially the same functions and configurations are allotted with the same reference numerals so that repeated description is omitted.

Description will be given for an embodiment of the present invention based on FIG. 1 as follows.

FIG. 1 shows an inner structure of a dry electrophotographic color image forming apparatus. The image forming apparatus forms, for example, a multicolor or unicolor image on a predetermined recording member based on image data that is sent from each terminal device over a network, and the like. Here, the recording member for performing image formation is paper.

The above-described image forming apparatus is provided with a supply tray 20, visible image formation units 50 (50Y, 50M, 50C and 50B), a recording sheet conveyance portion 30 and a fixing device 40.

The above-described image forming apparatus has four visible image formation units 50Y, 50M, 50C and 50B that are arranged side by side, corresponding to each color of yellow (Y), magenta (M), cyan (C) and black (B). Namely, the visible image formation unit 50Y performs image formation with use of a toner of yellow (Y), the visible image formation unit 50M performs image formation with use of a toner of magenta (M), the visible image formation unit 50C performs image formation with use of a toner of cyan (C), and the visible image formation unit 50B performs image formation with use of a toner of black (B). As specific arrangement, a so-called tandem system is provided that four sets of the visible image formation unit 50 are disposed along a conveyance path of a recording sheet which connects the supply tray 20 of the recording sheet P and the fixing device 40.

Each of the visible image formation units 50 has a substantially same configuration. Namely, each of the visible image formation units 50 is provided with a photoreceptor drum 51, a charger 52, a laser beam irradiation portion 53 (here, referred to a laser beam irradiation portion for writing a latent image into a photoreceptor drum), a developing equipment 54, a transfer roller 55, and a cleaner unit 56, and performs multi layer transfer with the toner in each color to the recording sheet P to be conveyed.

Here, the above-described photoreceptor drum 51 carries an image that is formed.

The above-described charger 52 uniformly charges the surface of the photoreceptor drum 51 to a predetermined potential.

The laser beam irradiation portion 53 exposes the surface of the photoreceptor drum 51 charged by the charger 52 corresponding to image data input to the image forming apparatus, and forms an electrostatic latent image on the surface of the photoreceptor drum 51.

The above-described developing equipment 54 visualizes the electrostatic latent image formed on the surface of the photoreceptor drum 51 with the toner in each color.

The transfer roller 55 has bias with polarity opposite to that of the toner applied thereto, and transfers a toner image that is formed on the surface of the photoreceptor drum 51 to the recording sheet P conveyed by the recording sheet conveyance portion 30 described below.

The drum cleaner unit 56 removes and collects a toner remained on the surface of the photoreceptor drum after developing processing in the developing equipment 54 and transfer of an image formed on the photoreceptor drum 51.

Transfer of a toner image to the recording sheet P as described above is repeated four times for four colors.

The recording sheet conveyance portion 30 includes a driving roller 31, an idling roller 32 and a conveyor belt 33, and conveys the recording sheet P so that a toner image that is formed with the visible image formation units 50 is transferred to the recording sheet P.

The driving roller 31 and the idling roller 32 are provided for stretching out the endless conveyor belt 33, and the driving roller 31 rotates at a predetermined circumferential speed under control so as to rotate the endless conveyor belt 33.

The conveyor belt 33 generates static electricity on an outer surface thereof, and conveys the above-described recording sheet P with electrostatic attraction.

After the toner image is transferred while being conveyed by the conveyor belt 33 in this manner, the above-described recording sheet P is peeled off from the conveyor belt 33 at curvature of the driving roller 31 to be conveyed to the fixing device 40.

The fixing device 40 applies appropriate heat to the recording sheet for fusing a toner to be fixed to the recording sheet so as to form a robust image.

Figure 2:
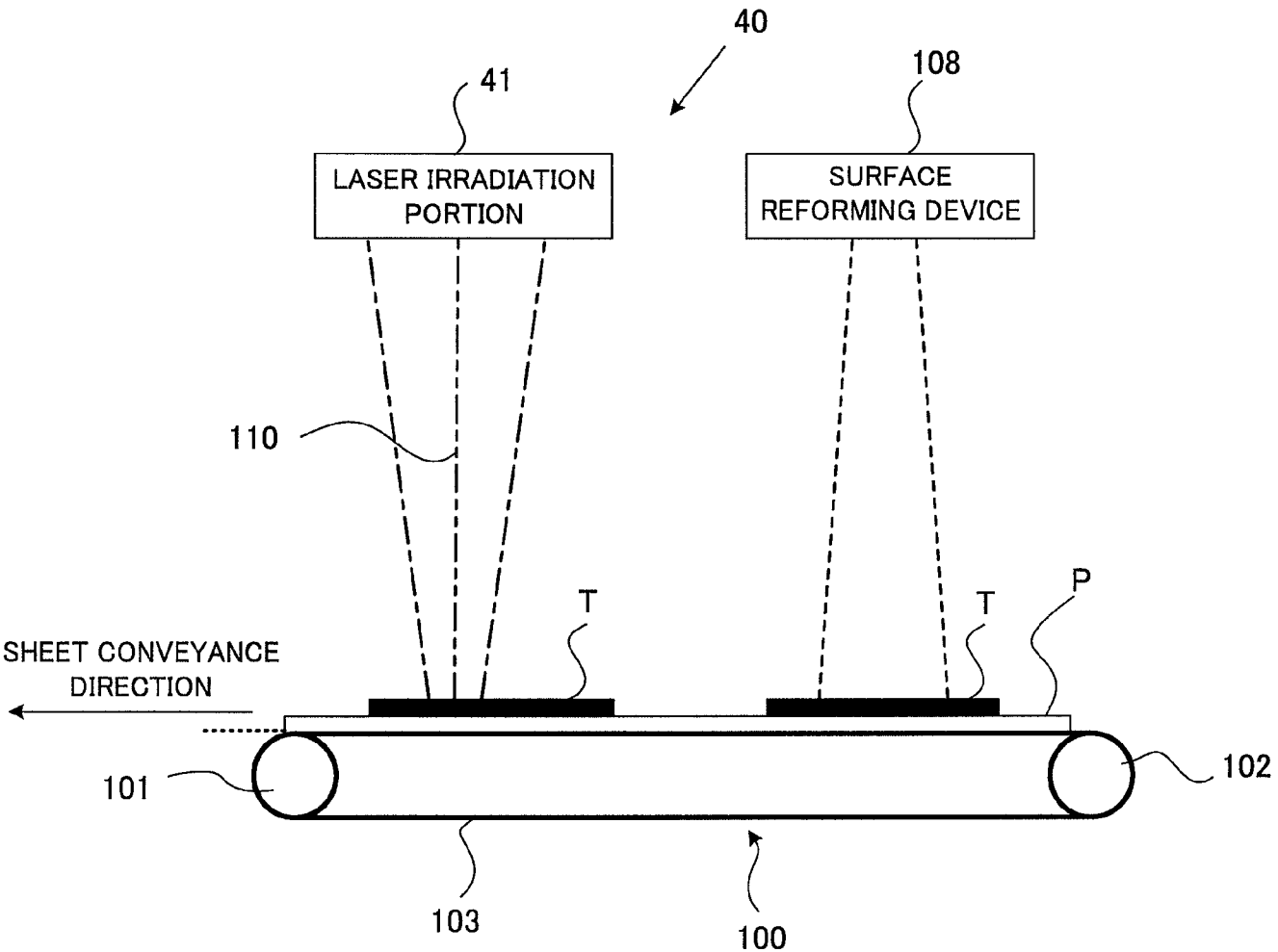
FIG. 2 is a schematic view showing a fixing device that is used for the image forming apparatus.

Description will be given in detail for the above-described fixing device 40 using FIG. 2. FIG. 2 is a view in the case of viewing from the side of the laser fixing device 40 in a sheet conveyance direction.

The fixing device 40 includes a laser irradiation portion (noncontact fixing portion) 41, a recording sheet conveyance device 100 for conveying the recording sheet P and a surface reforming device 108.

The recording sheet conveyance device 100 is comprised of two tension rollers 101 and 102, and an endless recording sheet conveyor belt 103 having heat resistance, in which the recording sheet P is conveyed on the belt 103.

Each of the two tension rollers 101 and 102 has an unillustrated shaft core which is connected to an unillustrated bearing, and the tension roller 101 is connected to an unillustrated driving portion via an unillustrated gear.

The recording sheet conveyor belt 103 is comprised of materials in which a conductive member such as carbon is dispersed in a resin such as polycarbonate, vinylidene fluoride, polyamide-imide, or polymide, and configured so that voltage is applied by means of unillustrated bias applying means that is connected to an inner surface of the recording sheet conveyor belt 103, whereby the recording sheet P is electrostatically attracted to the surface (outer peripheral face) of the recording sheet conveyor belt 103.

The recording sheet P is electrostatically attracted to the recording sheet conveyor belt 103 so that the recording sheet conveyor belt 103 adheres tightly to the recording sheet P, and it is possible to prevent the recording sheet P from floating as much as possible.

The surface of the recording sheet conveyor belt 103 intersects with a surface vertical to a light axis 110 as shown in FIG. 2.

The surface reforming device 108 is installed on an upstream side in the sheet conveyance direction with respect to the laser irradiation portion 41 having a laser beam source, and reforms the surface of a toner T on a sheet having an unfixed image thereon.

As surface reforming treatment, treatment capable of reforming a surface of a toner may be available including atmospheric-pressure plasma treatment, low-pressure plasma treatment, corona discharge treatment and ultraviolet treatment and the like. For example, there is an atmospheric-pressure plasma treatment device as such a surface reforming device.

The atmospheric-pressure plasma treatment device performs surface reformation by generating glow discharge in atmospheric pressure, which device is thus able to be simplified compared to that of vacuum plasma treatment, and as shown in FIG. 2, it is possible to continuously irradiate to what is continuously conveyed such as a sheet in atmospheric pressure. Therefore, here, it is assumed that a plasma irradiation device is used as the surface reforming device 108.

Figure 3B:
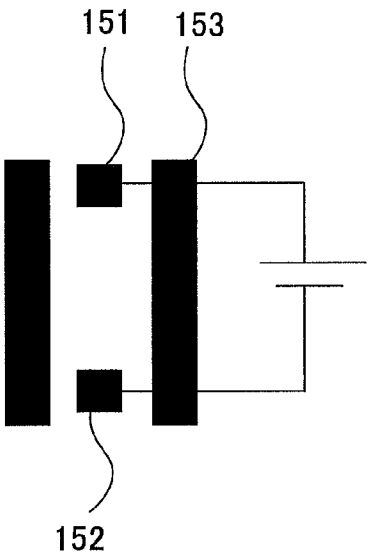
FIG. 3 is a schematic view showing a surface reforming device that is used for the fixing device.
Figure 3A:
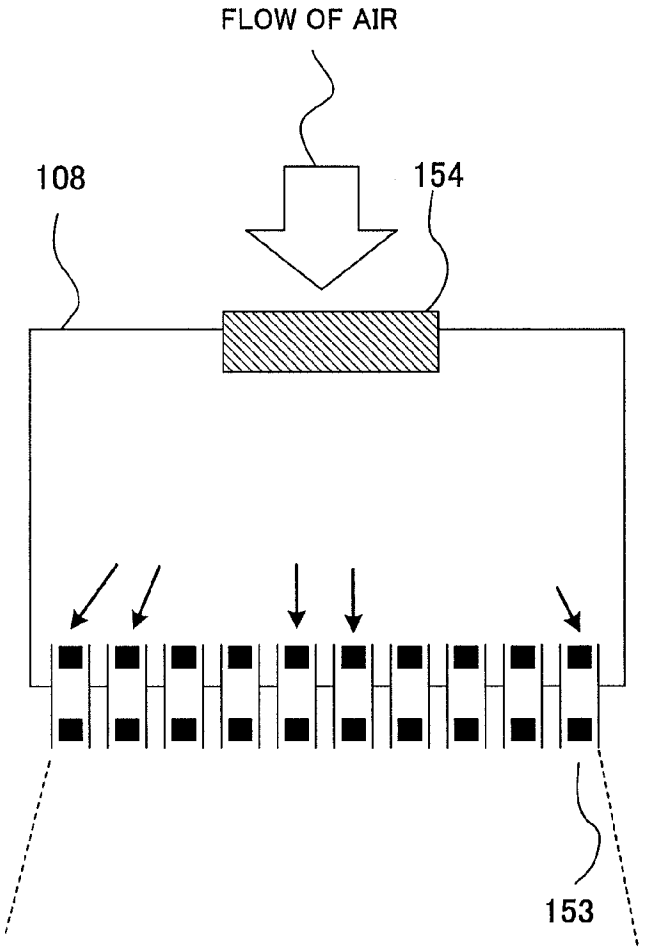

A specific configuration of the plasma irradiation device (surface reforming device) 108 is shown in FIG. 3. FIG. 3A is a vertical longitudinal sectional view of the device in the case of viewing from a direction orthogonal to the sheet conveyance direction. FIG. 3B is a detailed view of a plasma irradiation nozzle 153.

In surface reformation by means of plasma irradiation, high voltage (for example, 2 to 10 kV) is applied to two electrodes 151 and 152, followed by application to the two electrodes (1 cm to 20 cm as a distance) in a range of 10 μA to 50 mA, then the air is flowed between the electrodes, so that oxygen or the like in the air generates a radical and radical oxygen attacks (reacts with a part with C-H binding in a resin) a surface of a toner (for example, a major component of the toner is a resin such as polyester and styrene acryl), thereby generating on the surface of the toner T a hydrophilic group such as an OH group and a carbonyl group.

On the other hand, on the surface of the recording sheet P, many OH groups (OH group belonging to cellulose serving as a major component of paper) are present, and it is thus possible to increase adhesiveness to the recording sheet P.

A surface treatment device takes outside air into the device by means of a fan 154 (FIG. 3A) to deliver plasma to a surface of a toner.

Note that, a plasma generator in atmospheric pressure includes, for example, a plasma irradiation surface reforming device PS-601SW (manufactured by Wedge Co., Ltd.) and an atmospheric pressure plasma irradiation device disclosed in Japanese Patent Application Laid-open No. 2009-87697 and the like, and may have any configuration in which such a plasma irradiation device makes it possible to introduce a hydrophilic group onto a surface of a toner.

For example, it is described in a catalog of PS-601SW that wettability is improved (higher numerical values cause a hydrophilic property to be increased, thus having favorable wettability, thereby easily having diffusion (adherence) to a sheet) by a test method according to JIS K6768 (test method of plastic wettability). As a specific example, for wettability before and after surface treatment, polyethylene (PE) is improved from 31 mN/m to 70 mN/m, and in the same manner, acryl is improved from 38 mN/m to 70 mN/m, and the like, as well as improving wettability for many other resins, and besides, it is also possible to improve wettability of a polyester resin and an acrylic resin which are major components of a toner by applying surface treatment as with these PE and acryl.

Figure 4B:
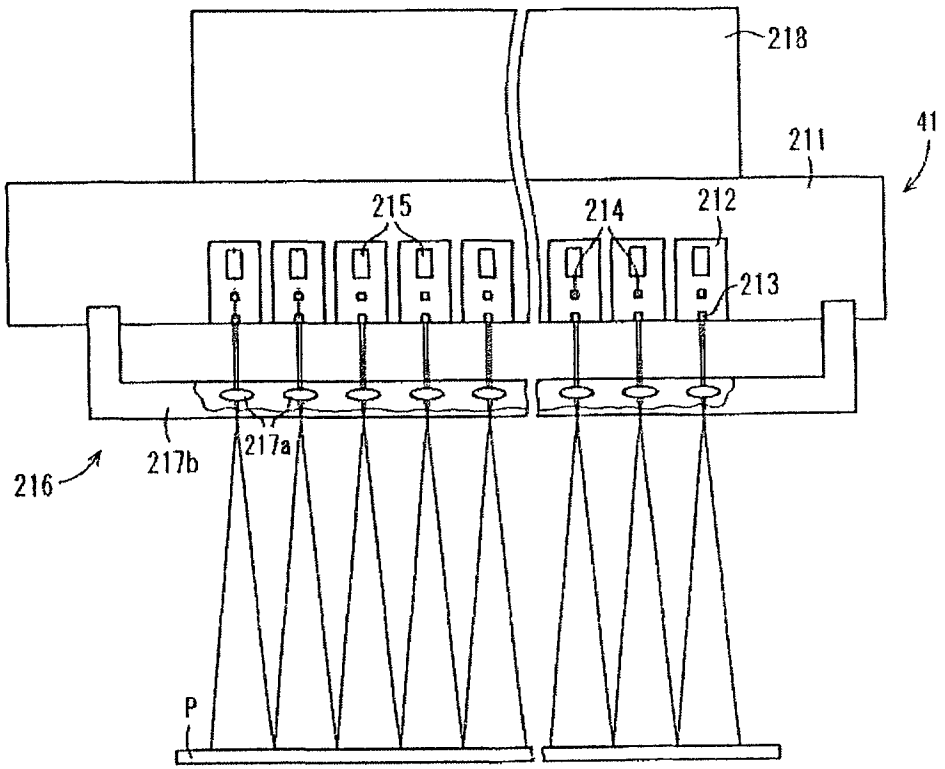
FIG. 4 is a schematic view showing laser irradiation means that is used for the fixing device.
Figure 4A:
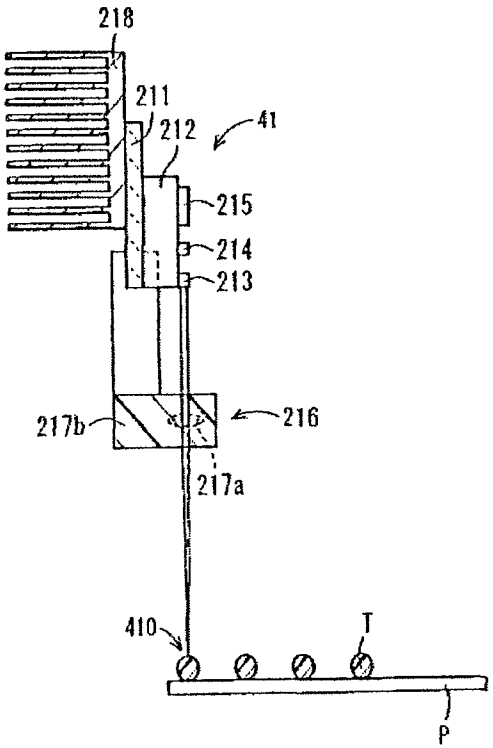

FIG. 4 is a view showing a configuration of the laser irradiation portion 41. FIG. 4A is a cross-sectional view of the laser irradiation portion 41 along a conveyance direction of the recording sheet P, and FIG. 4B is a front view of the laser irradiation portion 41 in the case of viewing from the conveyance direction of the recording sheet P.

The laser irradiation portion 41 is a device for emitting a laser beam. In the present embodiment, in the laser irradiation portion 41, a plurality of semiconductor laser elements 213 are provided across a width direction of the recording sheet conveyor belt 103 for fixation.

The plurality of semiconductor laser elements 213 serving as a semiconductor laser element array are arrayed in a line in a direction orthogonal to the recording sheet conveyance direction having equal space from the surface of the recording sheet conveyor belt 103, respectively. That is, the semiconductor laser element array is disposed parallel to the surface of the recording sheet conveyor belt 103.

A laser beam that is emitted from the semiconductor laser element 213 has a cross-section in an approximately true circle shape vertical to an emission direction that is a direction to which the laser beam moves.

Each of the semiconductor laser elements 213 is provided so that each emission direction of a laser beam to be emitted is all the same, so as to be a direction vertical to a direction in which the semiconductor laser elements 213 are arrayed.

As the semiconductor laser element 213, one having a wavelength of a laser beam to be emitted that is 400 nm to 1000 nm is arbitrarily selectable.

Each semiconductor laser element 213 is provided on each silicon substrate 212 that is formed of silicon.

On the silicon substrate 212, an unillustrated control circuit and a light receiving element 214 are monolithically formed.

The light receiving element 214 is photodiode for a monitor.

The control circuit controls voltage that is applied to the semiconductor laser element 213 based on a signal that is input from the light receiving element 214 so that output of a laser beam is changed and kept constant.

The control circuit and the semiconductor laser element 213 are electrically connected to each other via an unillustrated electrode and a bonding wire.

Additionally, on the silicon substrate 212, a temperature sensor 215 such as a thermistor is provided in order to measure temperature of each semiconductor laser element 213.

The control circuit controls voltage that is applied to the semiconductor laser element 213 based on temperature data that is detected by the temperature sensor 215.

The silicon substrate 212 is provided on a ceramic substrate 211 on the surface opposite to the surface on which the semiconductor laser element 213 is provided. A not-shown electrode on the ceramic substrate 211 and a not-shown electrode on the silicon substrate 212 are electrically connected to each other by wire bonding or the like.

Further, in the ceramic substrate 211, a heat sink 218 is provided on the surface opposite to the surface on which the silicon substrate 212 is provided.

A lens array 216 is provided on a downstream side in an irradiation direction of the semiconductor laser element 213.

The lens array 216 includes the same number of a convex lens 217*a* as a total number of semiconductor laser elements 213, and a lens holder 217*b* for holding the convex lens 217*a*.

The lens array 216 is configured so that a laser beam emitted from each of the semiconductor laser elements 213 enters each of the convex lenses 217*a*, respectively.

As described above, the laser irradiation section 41 in the present embodiment is a semiconductor laser element array in which a plurality of semiconductor laser elements 213 are arrayed in a line in a direction vertical to the recording sheet conveyance direction (width direction of the recording sheet conveyor belt 103 for fixation) having equal space from the surface of the recording sheet conveyor belt 103 for fixation, respectively. Namely, the semiconductor laser element array is disposed parallel to the surface of the recording sheet conveyor belt 103 for fixation.

For example, in the case of irradiating an entire surface of the recording sheet P with light by one laser beam source, it is needed to scan with a laser beam in a width direction of the recording sheet P. Accordingly, it takes time for a fixing process, thus having a limitation in fixing at high speed. Furthermore, scanning of the laser beam causes the device to be complicated and have cost increases.

Whereas, the laser irradiation portion 41 is configured to be the semiconductor laser element array so that it is not needed to scan with a laser beam in the width direction of the recording sheet P, thus making it possible to fix at high speed with a simple device configuration.

Moreover, rather than high output with one laser beam source, high output in a configuration in which a plurality of semiconductor laser elements 213 are provided makes an area of a heat radiation portion in the laser irradiation portion 41 larger. It is possible to improve a heat transfer efficiency to the heat sink 218 which is the heat radiation portion.

The recording sheet P has an unfixed toner image that is formed thereon with the visible image formation unit 50, and is conveyed to the fixing device 40.

The surface reforming device 108 of the fixing device 40 performs surface reformation for the surface of the toner T on the recording sheet P by, for example, plasma irradiation or the like, thereby generating a polar group of a hydrophilic property on the surface of the toner.

Next, the recording sheet P is conveyed to the laser irradiation portion 41 by the recording sheet conveyance device 100 to be irradiated with a laser, in which the toner T is fused to be fixed to the recording sheet.

The toner T on the recording sheet P is subjected to surface reforming treatment, thus having increased affinity (adhesion force) with the recording sheet P, so that it is possible to secure favorable fixability without pressing.

Additionally, as a noncontact-fixing method, heating is performed by light irradiation so that there is no need for warm-up of a heating portion, and it is possible to heat and fuse instantly only at the time of desired fixation to effectively perform fixation.

Note that, noncontact fixation by means of a laser is performed in the embodiment, however, noncontact fixation may be performed by means of light irradiation with a flash lamp, an LED and the like, oven heating and the like.

However, since a laser has less light diffusion, a largest amount of light is able to be condensed by the combined use of a laser and a condensing lens so that it is possible to bring maximum light intensity (light output per unit area: $W/mm^2$), thus making it possible to effectively irradiate with light.

Further, in the case of laser irradiation, it is possible to selectively heat only a location where a toner is present, and the toner is able to be further effectively heated.

Additionally, a semiconductor laser is used among lasers so that it is possible to reduce the cost because of lower cost of elements compared to use of a CO2 laser (carbon dioxide laser) and a YAG laser (solid-state laser using yttrium/aluminum/garnet).

For example, in the case of irradiating an entire surface of a sheet with light by one laser beam source, it is needed to scan with a laser in a sheet conveyance direction and a vertical direction other than a conveyance direction of the sheet. Accordingly, it takes time for a fixing process, thus having a limitation in fixing at high speed. Furthermore, scanning of a laser causes the device to be complicated and have cost increases. On the other hand, lasers are disposed in a line in the sheet conveyance direction and the vertical direction so that it is not necessary to scan with a laser in the sheet conveyance direction and the vertical direction, thus enabling use in a most basic configuration and also fixation at high speed.

Hereinbefore, the embodiments of the present invention have been described in detail with reference to the drawings, however, a specific configuration is not limited to such embodiments, and design and the like without departing from the spirit of the present invention may be made within the scope of the appended claims.

What is claimed is:

1. A fixing device for fixing an unfixed toner image in noncontact while conveying a recording member on which the toner image is formed, comprising:

a surface reforming portion for reforming a surface of the toner on the recording member so as to increase affinity to the recording member in heating and fusing; and a noncontact fixing portion for heating and fusing in noncontact the toner whose surface is reformed, and wherein the recording member is paper, and wherein the surface reforming portion is arranged on an upstream side of a conveyance direction of the recording member with respect to the noncontact fixing portion, and the surface reforming portion is configured to increase the affinity to the recording member by generating a polar group of a hydrophilic property on the surface of the toner, and wherein the noncontact fixing portion vertically irradiates light onto the toner whose surface is reformed, thereby fixing a toner image.

2. The fixing device according to claim 1, wherein the noncontact fixing portion uses a laser beam.

3. The fixing device according to claim 2, wherein the noncontact fixing portion uses a semiconductor laser.

4. The fixing device according to claim 3, wherein the noncontact fixing portion includes a laser array in which a plurality of semiconductor laser elements are disposed in an array in a direction orthogonal to a conveyance direction of the recording member.

5. An image forming apparatus comprising the fixing device according to claim 1.

* * * * *